United States Patent [19]

Aryamane et al.

[11] 3,944,768

[45] Mar. 16, 1976

[54] ROCKER SWITCH

[75] Inventors: Avinash Aryamane, Mount Prospect; Marvin A. Kruse, Chicago, both of Ill.

[73] Assignee: Littelfuse, Inc., Des Plaines, Ill.

[22] Filed: Nov. 30, 1973

[21] Appl. No.: 420,647

[52] U.S. Cl. ..... 200/67 G
[51] Int. Cl.[2] ..... H01H 13/28
[58] Field of Search..... 200/68, 67 G, 291

[56] References Cited

UNITED STATES PATENTS

| | | | |
|---|---|---|---|
| 2,734,959 | 2/1956 | Immel | 200/67 D |
| 3,324,952 | 8/1970 | Anderson et al. | 200/68 |
| 3,536,872 | 10/1970 | Gilardenghi | 200/67 G |
| 3,684,850 | 8/1972 | Kaderbek | 200/291 |
| 3,746,359 | 7/1973 | Lewis | 200/67 G |

*Primary Examiner*—David Smith, Jr.
*Attorney, Agent, or Firm*—Wallenstein, Spangenberg, Hattis & Strampel

[57] ABSTRACT

In a switch, a combination plunger and actuator member is resiliently floatingly mounted within a guideway in a handle member for movement toward and away from said handle member and which rocks with the pivoting of said handle member. There is provided stationary fulcrum-forming means against which a follower portion of said combination plunger and actuator member is resiliently urged, the shape of one of said fulcrum-forming means and follower portion being such that the distance of the outer end portion of said combination plunger and actuator member from said handle member varies as the handle member is moved between a first and a second position thereof. The combination plunger and actuator member has a spring engaging portion which engages a movable contact carrying member for moving the same between positions where said movable and stationary contacts are respectively in and out of engagement as the handle member is moved between said first and second positions thereof.

4 Claims, 14 Drawing Figures

FIG. 4
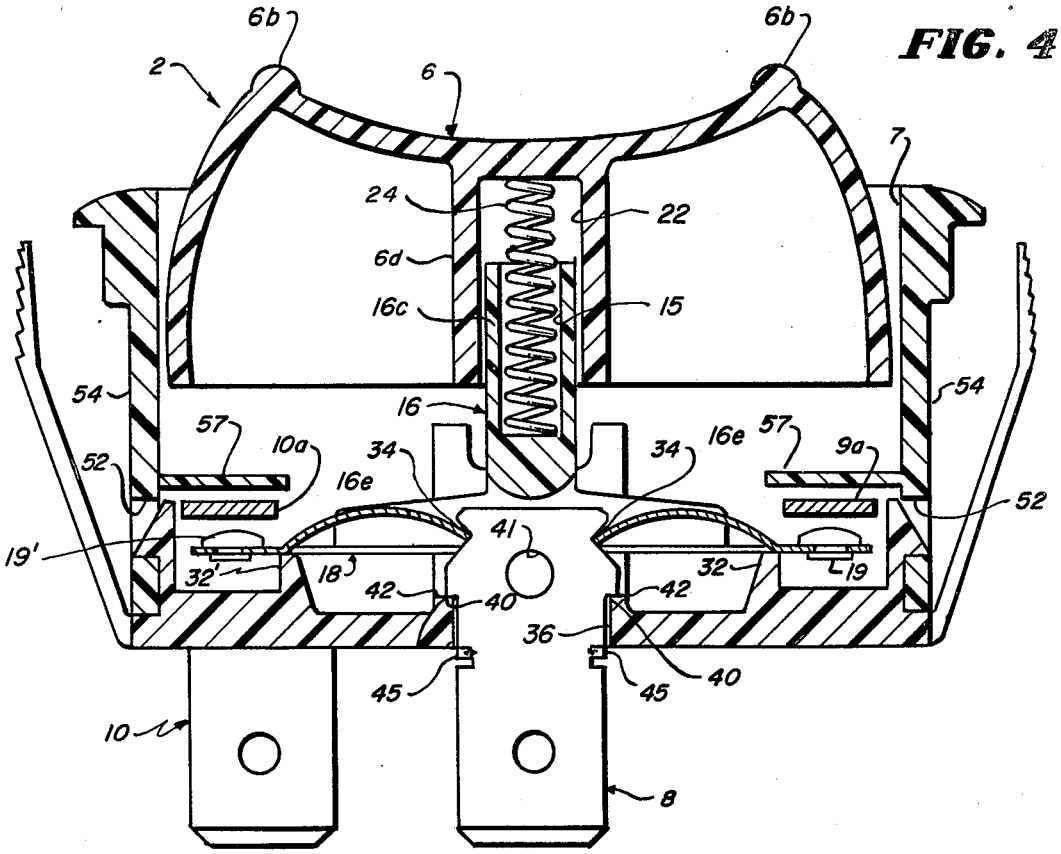
FIG. 5
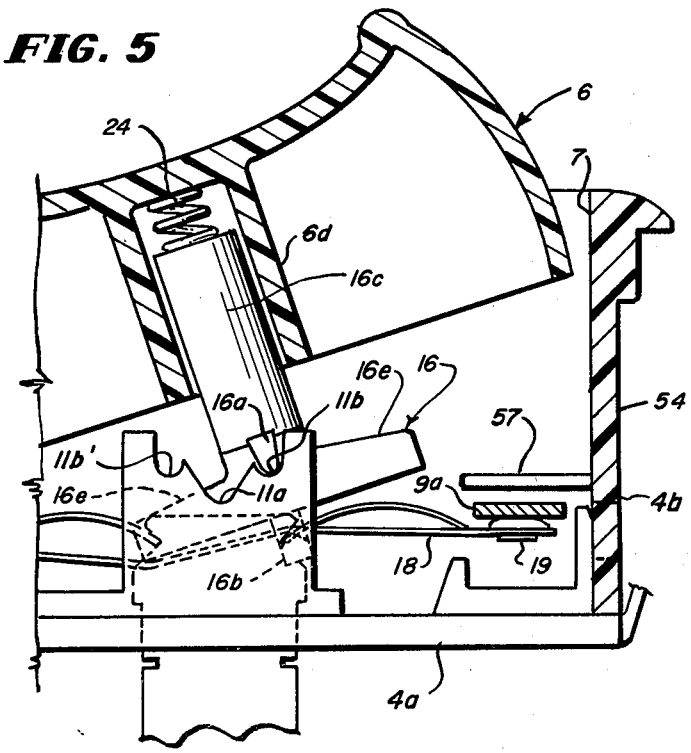
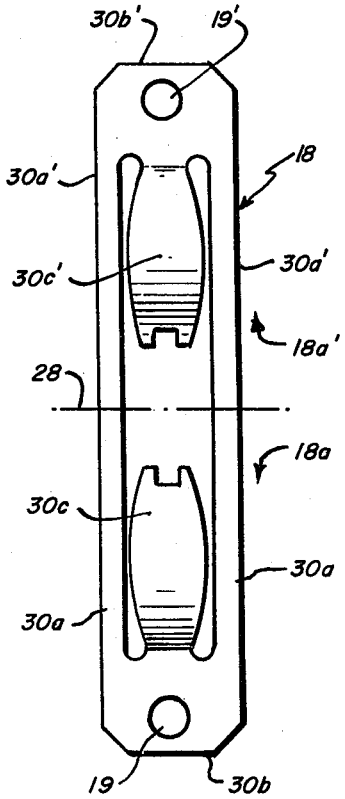
FIG. 6

ROCKER SWITCH

BACKGROUND OF THE INVENTION

The present invention relates to electrical switches, particularly to snap-action rocker switches of the general type exemplified by that shown in U.S. Pat. No. 2,734,959 to Immel, although certain aspects of the invention have a broader application.

A snap action switch of the type referred to has a handle member tiltable in one direction or the other from a center position, respectively to open or close circuits connectable between a terminal connected to a snap-action spring member carrying contacts on the ends thereof and terminals respectively extending to stationary contacts positioned opposite the ends of the spring member. The spring member most advantageously has a continuous peripheral portion surrounding an opening into which a pair of aligned terminals extend from the opposite ends of the spring member. The spring member is initially deformed into a given configuration and is supported so the two halves of the spring member can be snapped separately into a second configuration.

In the snap switch disclosed in said U.S. Pat. No. 2,734,959, the snap-action is achieved by depressing one tongue or the other by moving one of two operating members controlled by the handle member, which operating members are engaged respectively when the handle member is tilted in one direction or the other with respect to a central position. The contacts at the ends of the spring member make or break connection with stationary contacts placed adjacent thereto in one or the other of the two configurations of each half of the spring member. The use of a snap-action spring member for making or breaking contact is important in preventing or minimizing arcing and wear of the contacts.

One object of the invention is to provide an improved modified version of the type of rocker switch described above, preferably but not necessarily having the snap action spring member described, which can be manufactured at a lower cost. A related object of the invention is to provide a rocker switch as just described which can be mass produced reliably without the parts thereof being made to very close tolerances.

Another object of the invention is to provide a rocker switch as described which can be manufactured to operate in a number of different modes, such as a two position switch where the switch is self-holding in one or both positions thereof, or as a three position switch where the switch is self-holding in from one to three positions thereof by merely varying the shape of one of the parts thereof, thereby greatly reducing the complexity and variety of parts needed to manufacture a line of switches having the various modes of operation described.

SUMMARY OF THE INVENTION

In accordance with one feature of the invention, the handle member of the rocker switch is provided with a spring urged member which may in some respects be similar to the plunger member disclosed in U.S. Pat. Nos. 3,591,747 and 3,535,478, but uniquely modified along with other portions of the rocker switch to provide a more reliable rocker switch with fewer parts. To this end, the member mounted in the rocker switch handle member, instead of operating a separate pivotable switch actuator member as in the case of the rocker switches of U.S. Pat. Nos. 3,591,747 and 3,535,478, also forms the actuator member, so that the actuator member both reciprocates in a direction toward and away from the handle member and tilts with respect to the stationary parts of the switch. The reciprocating motion of the combination actuator member is determined by a fulcrum-forming means against which a follower portion thereof is spring urged. Either the fulcrum-forming means or the actuator member is provided with a motion imparting surface which is most advantageously a groove in the fulcrum-forming means so shaped that as the handle member is tilted in one direction or the other with respect to a centered position the combined plunger and actuator member is retracted toward the handle member. The actuator member has a portion which is sometimes referred to as a spring engaging or pulling and pushing portion which engages with a movable contact carrying member (such as the above described snap-action spring member) to open or close contacts in the various operating positions of the handle member. The motion imparting surface may be provided with locking shoulders so the spring force applied to the follower portion of the combination plunger and actuator member on the handle member will releasably lock the handle member in any one or more of its adjusted positions.

The fulcrum-forming means are preferably laterally spaced walls extending from a switch housing mounting base upon which the various parts of the switch unit including the terminal members, actuator member and the contact carrying member are mounted. These parts are preferably droppable into place upon the mounting base and, except perhaps for the terminal members which may be staked in place, are held thereon by the handle member, which is preferably a member snappable into position in an opening in the front wall of the housing of the switch.

In accordance with another feature of the invention, the switch actuator member has a portion which directly engages with the opposite sides of the middle section of the peripheral portions of a spring member of the type disclosed in said U.S. Pat. No. 2,734,959 (rather than the tongues thereof, as in the case of the rocker switch disclosed in this patent). In such case, the actuator member when tilted to one side of center pulls the peripheral half portion of the spring member adjacent one of the tongues into a position where the associated contact carrying end thereof snaps into a forwardly extending direction and when tilted to the other side of center pulls the peripheral half portion of the spring member adjacent the other tongue into a position where the associated contact carrying end thereof snaps into a forwardly extending direction. When the handle member is returned to its untilted center position, the spring engaging portion of the combination plunger and actuator member pushes the peripheral half portion of the spring member last deformed into a position where the associated contact carrying end thereof snaps back into its initial configuration.

DESCRIPTION OF THE DRAWINGS

FIG. 4 is a center longitudinal sectional view through the rocker switch shown in FIGS. 2 and 3;

FIG. 5 is a fragmentary sectional view, taken just beyond the plane of one of the housing side walls, showing the position of the switch actuating portions of the rocker switch when the handle thereof is tilted in one direction from its centered position;

FIG. 6 is a plan view of the movable contact-carrying snap action spring member forming part of the rocker switch of FIGS. 1–5 and separated from the rest of the switch components;

DESCRIPTION OF THE PREFERRED EMBODIMENT OF THE INVENTION

Figure 1:
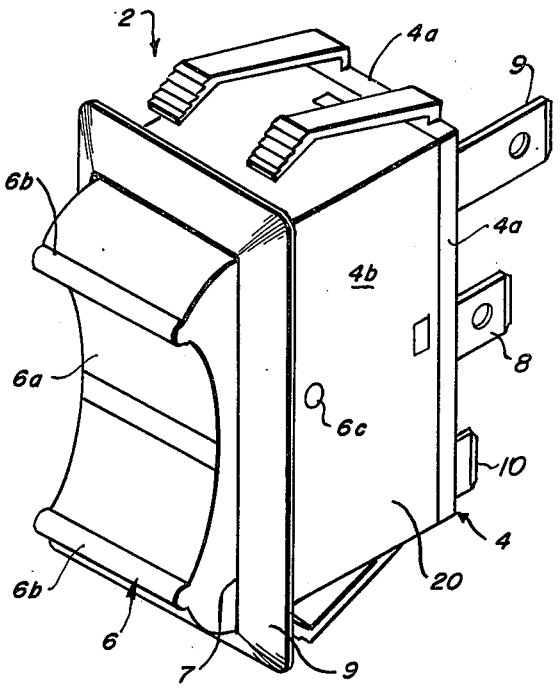
FIG. 1 is a perspective view of a preferred form of rocker switch of the present invention oriented in a vertical position to be mounted in an opening in a vertical panel.

The rocker switch illustrated and identified by reference numeral 2 in FIG. 1 is comprised of a housing generally indicated by reference numeral 4 made up of a mounting base **4*a* forming the rear wall of the switch when supported in a vertical position as shown in FIG. 1, and an open ended box-like body 4*b* which fits over and is secured to the mounting base in a manner to be described. A pivotally mounted handle member shown in the form of a push button 6 is mounted in and projects from an opening 7 in the bezel portion 9 of the housing body 4*b*. While some forms of the invention have only two terminals, in the embodiment illustrated in FIGS. 1–9, three terminal members, 8, 9 and 10** project from the mounting base which supports various parts of the rocker switch to be described.

The rocker switch in the different positions of the handle member 6 open or close contacts to be described connected between terminal member pairs 8–9 and 8–10 respectively, the terminal member 8 being in common between the two switching circuits involved.

When the handle member 6 is in its untilted centered position shown in FIG. 4, depending upon whether there are normally open or normally closed contacts involved, the terminal member pairs 8–9 and 8–10 will either be open or short circuited. When the handle member 6 is tilted in one direction from its centered position, the condition of the contacts between only terminal members 8–9 will be reversed, and when the handle member 6 is tilted in the opposite direction from its centered position only the condition of the contacts between the terminal members 8–10 will be reversed. In some forms of the invention, the handle member is releasably locked into either one of its tilted positions, and in other forms of the invention the handle member returns to its initial position upon release of finger pressure on the push button handle member. In still other forms of the invention where only two terminal members need be provided, the handle member 6 has only two different operating positions rather than the three just described. All the different modes of operation of the rocker switch described can be obtained by merely varying the shape of motion-imparting surfaces formed by grooves 11—11 (other examples of which are illustrated in FIGS. 11–14) formed on a pair of laterally spaced fulcrum-forming walls 13—13 extending transversely inwardly from the mounting base **4*a***.

The handle member 6 floatingly supports a combination plunger and actuator member 16 which has projecting follower portions **16*a*—16*a* which are spring urged against the defining walls of the grooves which effect translation of the combination plunger and actuator member as the handle member 6 is moved between its centered and its oppositely tilted positions. The combination plunger and actuator member 16 has hook-shaped spring engaging means 16*b*—16*b* (sometimes referred to as a spring pulling portions) which engage with a snap-action spring member 18 carrying contacts 19 and 19′ at opposite ends thereof. Each longitudinal half of the spring member 18 is adapted to snap between initial relatively flat and outwardly inclined configurations which make or break connection between the contacts 19 or 19′ and contact forming ears 9*a* or 10*a* of the terminal members 9 and 10.**

Now that the various parts of the rocker switch have been briefly introduced and their functions briefly explained, the specific details of and the interconnections between the parts of the most preferred form of rocker switch of the present invention as illustrated in the drawings will be described.

The handle member, which is preferably a push button type handle member, is shown having a concave shaped front face 6a terminating in ridges **6*b*—6*b* at the opposite longitudinal ends of the push button handle member, to permit the handle member to be readily rocked between oppositely tilted positions thereof. The push button handle member has parallel side faces 21—21 from which laterally extend projections 6*c*—6*c* which are pivotally mounted within apertures 23—23 formed in the side walls 20—20 of the open ended box-like housing body 4*b***.

The push button handle member 6, which is preferably made of synthetic plastic material of the same type as the housing 4, is a hollow member having on the interior thereof a downwardly extending sleeve 6d forming a downwardly open guideway 22 in which is slidingly mounted for movement an open-top plunger-forming portion **16*c* of the combination plunger and actuator member 16. A coil spring 24 is compressed between the upper defining wall of the guideway 22 and the bottom defining wall of a bore 15 in the plunger-forming portion 16*c* of the combination plunger and actuator member 16, so the coil spring 24 urges the combination plunger and actuator member in the direction of the mounting base 4*a***.

The plunger-forming portion **16*c* of the combination plunger and actuator member 16 terminates in a transversely extending bridging portion 16*d* from the ends of which longitudinally extend longitudinal arms 16*e*—16*e* (sometimes referred to as spring pushing portions) which overlie longitudinal portions of the spring member 18** to be described. The follower portion 16*a*—16*a* of the combination plunger and actuator member form lateral extensions of the bridging portion 16d and are urged by the spring member 24 into the motion imparting grooves 11—11 of the fulcrum-forming walls 13—13.

The aforementioned hook-shaped spring engaging means 16*b*—16*b* are extensions of the bottom portions of the bridging portion 16*d* of the combination plunger and actuator member 16. These hook-shaped portions 16*b*—16*b* form laterally confronting slots 26—26 into which extend the central portion of the spring member 18. Before explaining the manner in which the movement of the combination plunger and actuator member 16 imparts snap action movement to the spring member 18, the configuration of the spring member best shown in FIG. 6 will first be described. As best shown in FIG. 6, the spring member, which preferably has an elongated configuration, can be divided into two longitudinal halves 18*a* and 18*a'* by a longitudinal transverse center line 28. Each longitudinal spring member half is comprised of a pair of longitudinal peripheral portions 30*a*—30*a* or 30*a'*—30*a'* interconnected at their ends by a transverse end portion 30*b* or 30*b'* carrying the movable contact 19 or 19'. Extending longitudinally inwardly from the end portions 30*b*—30*b'* are aligned bowed tongues 30*c*—30*c'*. The spring member 18 is a stamping from a sheet of spring metal where the peripheral portions thereof above described form a continuous band surrounding a central opening into which the aforementioned tongues 30*c*—30*c'* extend.

Figure 3:
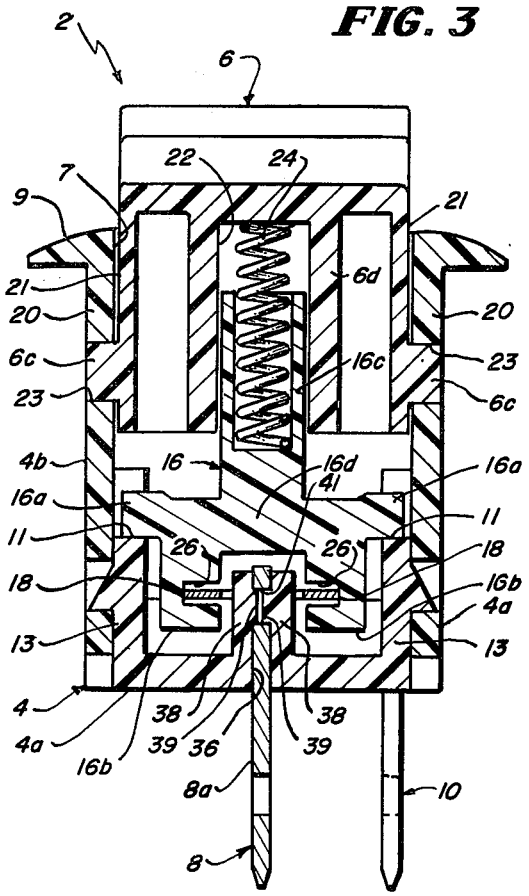
FIG. 3 is a center transverse sectional view through the rocker switch shown in FIG. 2.
Figure 2:
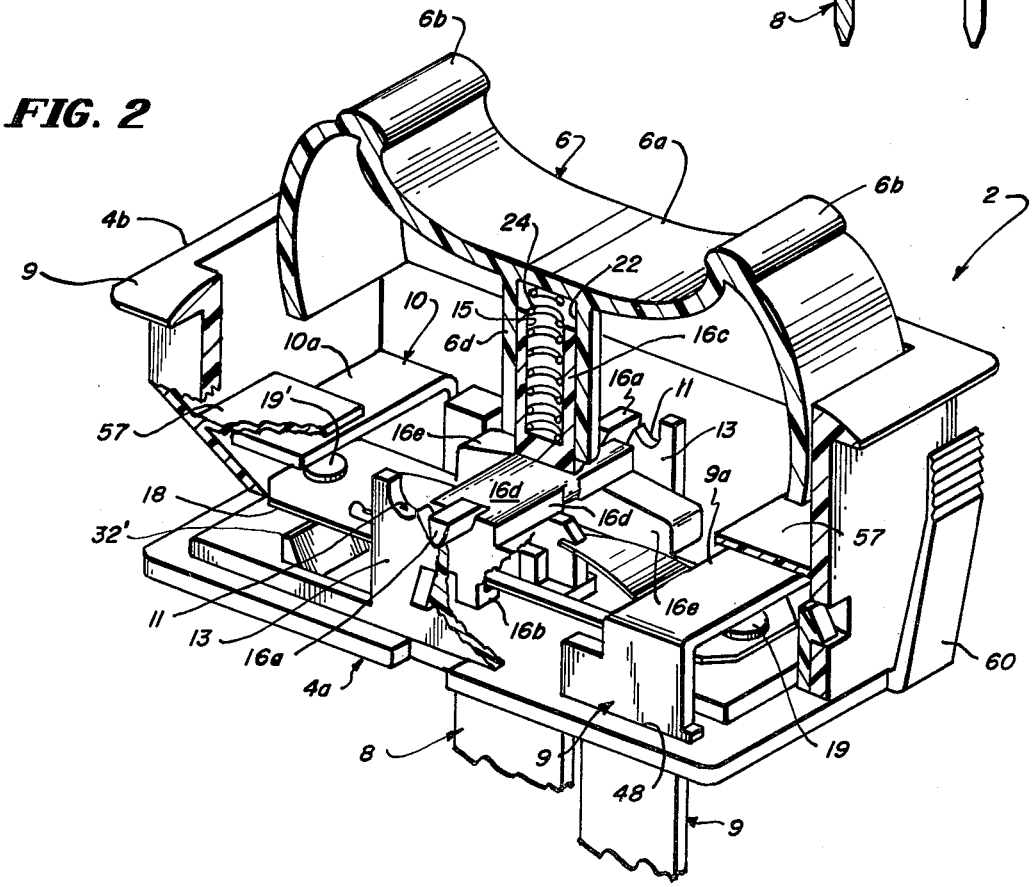
FIG. 2 is a perspective view of the rocker switch of FIG. 1 oriented horizontally, which is its position when the parts thereof are assembled, the walls of the housing being broken away to show the interior parts of the switch.

The spring member is positioned upon ribs 32—32' (FIG. 4) projecting transversely from the mounting base 4*a* so it extends generally parallel to the mounting base 4*a* with the convex side of the tongues 30*c*—30*c'* facing away therefrom. The ends of the tongues 30*c*—30*c'* are anchored under tension within positioning grooves 34—34 formed in the upper portion of the terminal member 8. The terminal member 8 projects through an opening 36 formed in the mounting base 4*a*. Projecting inwardly in parallel relation and alignment with the margins of the opening 36 are a pair of guidewalls 38—38 which define therebetween a continuation of the opening 36 in the mounting base 4*a* (FIG. 3). The downward movement of the terminal member 8 through the opening 36 is limited by the engagement of shoulders 40—40 of the head portion of the terminal member (FIG. 4) with positioning ribs 42—42' extending inwardly from the mounting base 4*a*. As shown in FIG. 3, the guidewalls have confronting pins 39—39 which snap into an opening 41 in the terminal member 8. While for assembly purposes it is preferred that the terminal member 8 be snapped into place and stably supported without any staking operation, it was determined that the staking of the terminal member 8 at 45—45 against the outer surface of the mounting base is desirable to achieve a secure anchoring of the terminal member 8. However, it is anticipated that the intermediate terminal member 8 could be anchored only by the pins 39—39.

Figure 10:
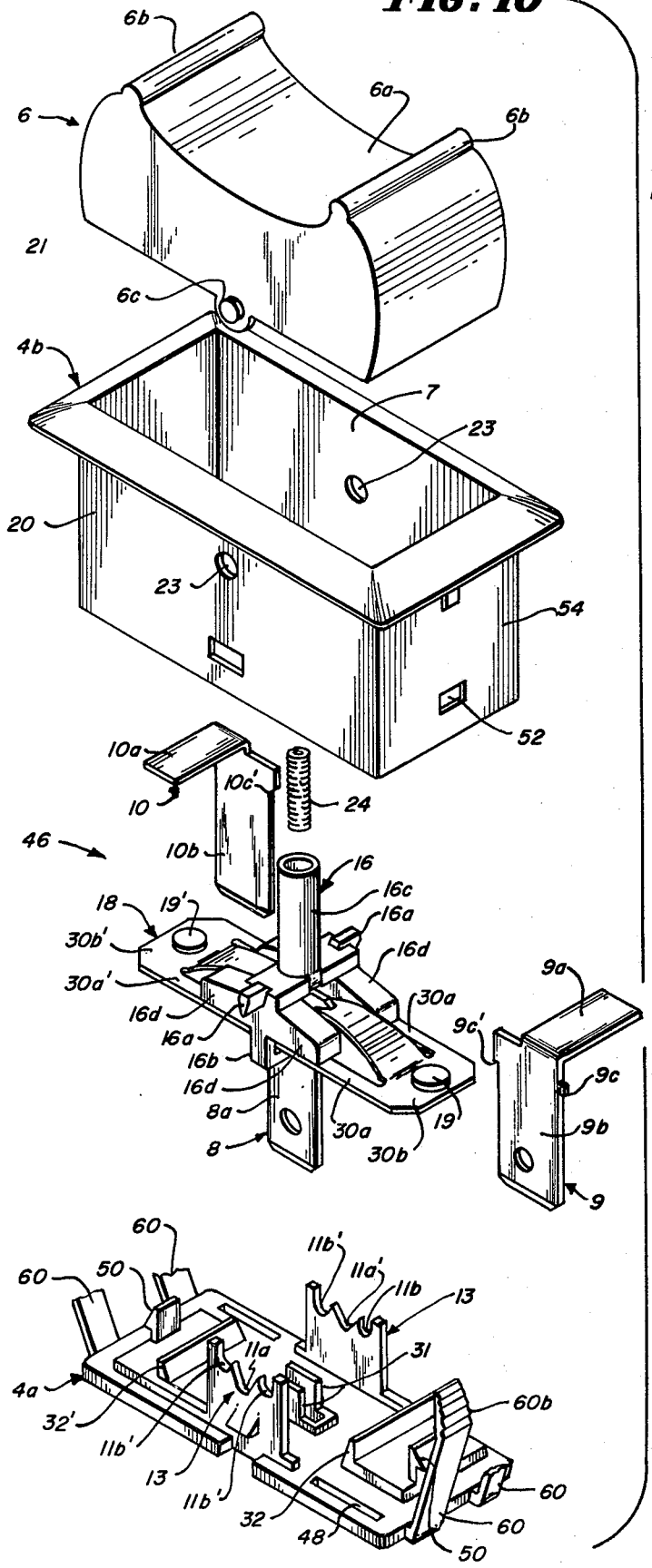
FIG. 10 is an exploded view of the various parts or sub-assemblies thereof positioned roughly in the order in which they are dropped into position on the mounting base of the rocker switch.
Figure 11:
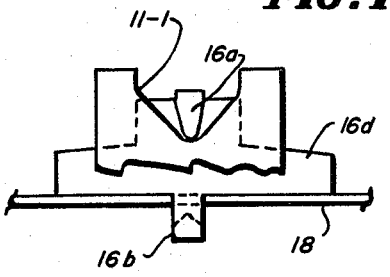
FIGS. 11–13 respectively show some of the different shapes of the fulcrum-forming and motion-imparting grooves shown in the switch of FIGS. 1–9 to provide different modes of operation of the rocker switch.

As best shown in FIGS. 5 and 10, the motion imparting groove 11 formed in each fulcrum-forming wall 13 has a lowermost centered portion 11*a*, a left hand shoulder-forming concave upper portion 11*b'*, and a right hand shoulder-forming concave upper portion 11*b*. When the handle member 6*a* is in its untilted centered position, the follower forming portions 16*a*—16*a* of the combination plunger and actuator member 16 ride in the centered lowermost portions 11*a*—11*a* of the motion imparting grooves 11—11. When the left side of the handle member 6 is depressed, the combination plunger and actuator member 16 is tilted and raised to the right as it retracts within the sleeve 16*d* of the handle member and the follower portions 16*a*—16*a* thereof ride up the centered groove portions 11*a*—11*a* and snap into the right upper concave groove portion 11*b*—11*b* under the force of compressed coil spring 24. When the right side of the handle member 6 is depressed, the combination plunger and follower member is tilted and raised to the left and the follower portions 16*a*—16*a* thereof ride up the centered groove portions 11*a*—11*a* and snap into the left upper concave groove portions 11*b'*—11*b '*.

Figure 7:
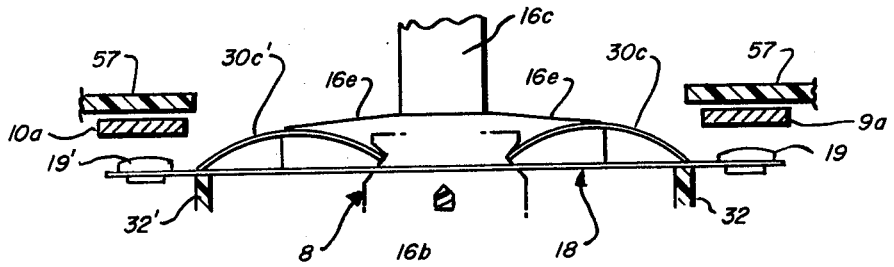
FIGS. 7–9 are diagrammatic views showing the different positions of the contact-carrying portions of the rocker switch of FIGS. 1–5, when the handle thereof is in a centered untilted position, when tilted up to the right and when tilted up to the left, respectively.
Figure 8:
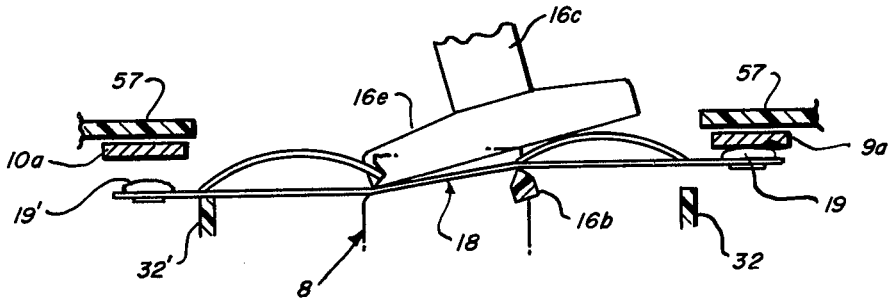
Figure 9:
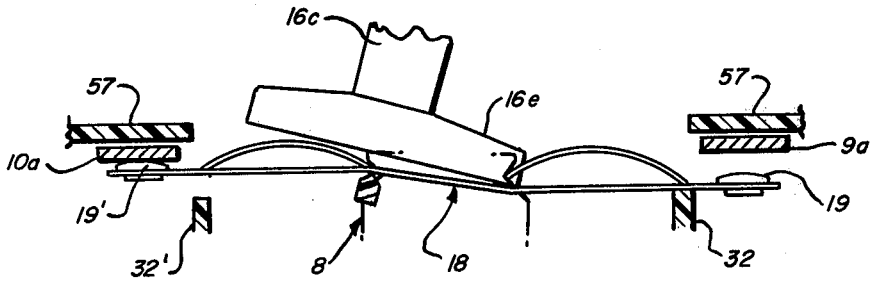

In the centered position of the handle member 6, the spring member 18 is in a generally flat condition shown in FIG. 7 where contacts 19—19' on the ends thereof are spaced from the contact-forming ears 9*a*–10*a* of the terminal members 9–10. The raising of the combination plunger and actuator member 16 to the right causes the hook-shaped spring engaging pulling portions 16*b*—16*b* thereof to pull the right longitudinal half 18*a* of the spring member 18 to a position where it will snap into a deformed position shown in FIG. 8 where the associated contact 19 engages the contact-forming ear 9*a* of the terminal member 9. Similarly, the raising of the combination plunger and actuator member 16 to the left causes the hook-shaped spring engaging pulling portions 16*b*—16*b* thereot to pull the left longitudinal half 18*a'* of the spring member to a position where it snaps into a deformed position shown in FIG. 9 where the associated contact 19' engages the contact-forming ear 10*a* of the terminal member 10. It should be noted from FIGS. 7–9 that when one longitudinal half of the spring member 18 is pulled into a position where it snaps into a contact closing position, the other longitudinal half of the spring member is pushed into its initial contact opening position by the engagement therewith of the longitudinal arms or pushing portions 16*e*—16*e* of the combination plunger and actuator member. When the handle member 6 is returned to its centered position, the spring engaging pushing portions 16*e*—16*e* of the combination plunger and actuator member 16 will push down upon the adjacent longitudinal half of the spring member to move the same to a position where the spring member snaps back into its initial position as shown in FIG. 7.

Figure 12:
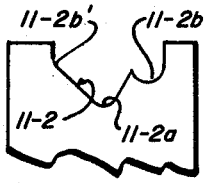

As previously indicated, by varying the shape of the motion imparting grooves 11—11 in the fulcrum-forming walls 13—13, as shown in FIGS. 11—14, different modes of operation of the rocker switch unit can be achieved. Thus, for example, referring now to FIG. 11, if each groove 11 were to be modified to form the groove 11-1 in FIG. 11, which has no upper shoulder-forming grooved portions, the handle member 6*a* will not be automatically held into either of its tilted positions so as finger pressure is released the handle member 6 automatically returns to its centered position. In FIG. 12, each motion imparting groove 11-2 provides a three position switch where only two of of the handle member positions are stable positions. Accordingly, each motion imparting groove 11-2 has a centered bottommost portion 11-2*a* which holds the handle member in a centered position, an unshouldered left hand portion 11-2*b'* where the associated follower portion 16*a* of the combination plunger and actuator member 16 must be held with finger pressure to effect a contact closure, and a shoulder-forming right hand portion 11-2*b* where the handle member automatically is held in a left hand depressed condition.

Figure 13:
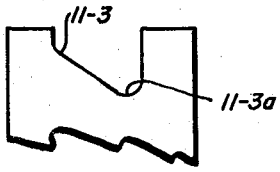
Figure 14:
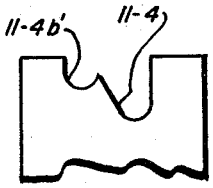

With the motion imparting groove configuration shown in FIG. 13, the rocker switch acts as a two position switch by virtue of the fact that the lowermost portion 11-3*a* of each groove 13*a* is positioned to the right of center and defines the right hand margin of the motion imparting groove 11-3. When the follower portions 16*a*—16*a* of the combination plunger and actuator member 16 are engaged in the lowermost groove portions 11-3*a* to the right of center of the groove, the spring engaging portions 16*b*—16*b* of the combination rocker and actuator member 16 are too low to effect any spring member raising operation. When the right side of the handle member 6 of the switch is depressed, the follower portions 16*a*—16*a* of the combination plunger and actuator member 16 will be raised to a point where the longitudinal half 18*a*′ of the spring member 18 is pulled into a snapping position where the contact 19′ engages the contact-forming ear 10*a* of the terminal member 10. Release of finger pressure automatically causes the handle member to assume its initial inoperative position In the motion imparting groove 11-4 shown in FIG. 14, the groove is similar to that shown in FIG. 13, except that there is a shoulder-forming left hand portion 11-4*b*′ wherein the handle member automatically is locked in its depressed condition until released by depression of the left side of the handle member. Where the rocker switch is a two position switch effected by motion imparting grooves like 11-3 and 11-4 in FIGS. 13 and 14, there is only a need for terminals 8 and 10, since terminal 9 performs no useful purpose because only one of the longitudinal halves of the spring member 18 are operable in performing switch opening and switch closing operations.

While in the rocker switches just described, the contact closing positions are effected by the raising of the follower portions 16*a*—16*a* of the combination plunger and actuator member 16, obviously the contact arrangement can be reversed so contacts are open rather than closed by a tilting and raising of the follower portions 16*a*—16*a* of the combination plunger and actuator member 16.

The manner in which the rocker switch shown in FIGS. 1—9 is assembled is shown by the exploded view in FIG. 10 where the various parts and sub-assemblies are shown in their positions ready to be dropped in sequence upon the mounting base section 4*a* of the housing. A sub-assembly 46 is formed made of the intermediate terminal member 8, the snap action spring member 18 and the combination plunger and actuator member 16 which are dropped into place as a unit upon the mounting base section where the terminal blade-forming portion 8*a* of the terminal member 8 projects downwardly beyond the mounting base section. Next, the terminal blade forming portions 9*b* and 10*b* of the terminal members 9 and 10 are respectively passed downwardly through openings 48 and 49 formed in the mounting base 4*a*, the downward movement of the terminal members being halted by the contact of shoulders like 9*c*—9*c*′ and 10*c*—10*c*′ upon the upper surface of the mounting base. Next, the open ended box-like body 4*b* is dropped into place over the mounting base 4*a*, the housing body snapping into a locked position over a pair of detents 50—50 extending upwardly from the mounting base 4*a* and resiliently engaging the defining walls of corresponding apertures 52—52 (FIG. 4) in the end walls 54—54 of the housing body. When the housing body 4*d* is in place, retaining walls 57—57 forming an integral extension of the housing body end walls 54—54 overlie the contact-forming ears 9*a* and 10*a* of the terminal members 9 and 10 to retain the same in place upon the mounting base 4*a*.

Either before or after the placement of the housing body 4*b* upon the mounting base 4*a*, the coil spring 24 is positioned within the plunger-forming portion 16*c* of the combination plunger and actuator member 16. The last step in assembly, except possibly for staking of the terminal 8 as previously described, is the insertion of the handle member 6 into the opening 7 in the top of the housing section 4*b* in a manner where the sleeve 6*d* thereof passes over the plunger-forming portion 16*c* of the combination plunger and actuator member 16, the handle member snapping into a locked position when the pivot-forming projections 6*c*—6*c* thereof snap into the openings 23—23 in the housing body 4*b*. The design of the rocker switch just described is thus one which can be readily assembled on a mass production basis by automatic assembly equipment.

The mounting base 4*a* has a pair of locking arms 60—60 at each end thereof which, in a well known manner, are adapted to enter a mounting opening in a mounting panel to retain the rocker switch in place. The arms 60—60 extend from a point contiguous to the mounting base 4*a* to a point just behind the bezel 9 of the housing body 4*b*, where serrated end portions 60*a* thereof will frictionally engage areas of the mounting panel contiguous to the mounting opening to retain the rocker switch in place, as is conventional with mounting arms of the same design heretofore used for mounting switches and other electrical devices in mounting panel openings.

The present invention has thus provided an exceedingly easy to assembly, inexpensive rocker switch construction which operates reliably with loose tolerances, and which has great flexibility of adaptation to different rocker switch modes of operation by merely changing the shape of motion imparting grooves.

It should be understood that numerous modifications made be made in the most preferred forms of the invention illustrated without deviating from the broader aspects thereof.

We claim:

1. In a switch including a handle member pivotable about a given axis, a movable contact carrying spring member having longitudinally spaced spring portions each of which individually snap into two different configurations when pulled toward or pushed away from said handle member, and a stationary contact to be engaged by the movable contact on said member, the improvement in operating means for interconnecting said handle member and said movable contact carrying member, said operating means comprising: an actuator member which is resiliently floatingly mounted on said handle member for movement toward and away from said handle member and which rocks with the pivoting of said handle member, stationary fulcrum-forming means against which a follower portion of said actuator member is resiliently urged, the shape of one of said fulcrum-forming means and follower portion being such that the distance of the outer end portion of said actuator member from said handle member varies as the handle member is moved between a first and a second position thereof, and said actuator member having member pulling and pushing portions on the outer end portion thereof which engage said spring member for moving the same between positions where said movable and stationary contacts are respectively in and out of engagement as the handle member is moved between said first and second positions thereof, said longitudinally spaced spring portions extending longitudinally on opposite sides of said pulling and pushing portions of said actuator member, said spring member being engagable on the sides facing both toward and away from said handle member by said pulling and pushing portions of the actuator member, said actuator member when tilted in one direction by said handle member causing the pulling and pushing portions thereof respectively to pull one of said spring portions into a position where it snaps into a configuration extending toward said handle member and push the other spring portion into a position where it assumes another configuration and when tilted in the opposite direction causing the pulling and pushing portions thereof to pull said other spring portion into a position where it snaps into a configuration extending toward said handle member and push said one spring portion into a position where it assumes another configuration, the return of the handle member to a centered position causing said pulling and pushing portions to push the previously deformed portion of the spring member into a position where it snaps into its previous configuration, and contacts at each end of said spring member respectively engagable with stationary contacts adjacent thereto in one of the configurations of the adjacent spring member portions.

2. In a switch including a handle member pivotable about a given axis; a stationary contact; a snap-action spring member having longitudinally spaced spring portions at least one of which is snappable into two different configurations when pulled toward or pushed away from said handle member; and a movable contact on the end of the latter longitudinal portion of said spring member which in one of its configurations brings said movable contact into engagement with said stationary contact, the improvement in operating means interconnecting said pivotably mounted handle member and said spring member for moving said latter portion of said spring member into positions where it snaps into said different configurations, said operating means comprising: a spring pulling and pushing member resiliently floatingly mounted on said handle member for movement toward and away from said handle member and which rocks with the pivoting of said handle member; stationary fulcrum-forming means against which a follower portion of said spring pulling and pushing member is resiliently urged, the shape of one of said fulcrum-forming means and follower portion being such that the distance of the outer end portion of said spring pulling and pushing member from said handle member varies as the handle member is moved between a first and a second position thereof; said spring pulling and pushing member having spaced confronting spring engaging pulling and pushing portions facing opposite sides of said spring member facing both toward and away from said handle member; said longitudinally spaced spring portions extending longitudinally on opposite sides of said pulling and pushing portions of said spring pulling and pushing member; said spring pulling and pushing member when tilted in one direction by said handle member causing the pulling portion thereof to pull said latter longitudinal spring portion into a position where it snaps into a configuration extending toward said handle member and when returned to its initial position causes said pushing portion of the spring pulling and pushing member to return said latter longitudinal portion of the spring member to its original configuration.

3. The switch of claim 1 wherein said spring member has a continuous peripheral portion including said longitudinally spaced portions thereof surrounding an opening, a pair of aligned tongues extending into said opening from opposite ends of said peripheral portion of said spring member, and anchoring means for anchoring the inner ends of said tongues so the peripheral portions of the spring member on opposite sides of the tongues can respectively assume independently of each other with a snap-action two different configurations when pulled toward or pushed away from said handle member.

4. The switch of claim 1 wherein said stationary fulcrum-forming means comprises a pair of laterally spaced stationary wall means having indentically spaced and positioned grooves facing in the direction of said handle member and into which aligned projecting portions of said actuator member ride.

* * * * *